United States Patent [19]

Zeigler

[11] 4,334,660

[45] Jun. 15, 1982

[54] COLLAPSIBLE BIN STRUCTURE

[76] Inventor: Theodore R. Zeigler, 205 S. Columbus St., Alexandria, Va. 22314

[21] Appl. No.: 108,013

[22] Filed: Dec. 28, 1979

[51] Int. Cl.[3] ..... A63B 55/04

[52] U.S. Cl. ..... 248/97; 248/100

[58] Field of Search ..... 248/94, 97, 98, 99, 248/100, 101, 150, 163 A, 165; 220/401, 404

[56] References Cited

U.S. PATENT DOCUMENTS

| | | | |
|---|---|---|---|
| 128,073 | 6/1872 | Roseborough | 248/100 X |
| 354,713 | 12/1886 | Lawson et al. | 248/97 X |
| 412,822 | 10/1889 | Yates | 248/97 |
| 514,481 | 2/1894 | Matier | 248/100 X |
| 748,387 | 12/1903 | Lilly | 248/97 |
| 3,240,457 | 3/1966 | Backlund | 248/97 X |
| 3,779,419 | 12/1973 | Heitz | 248/99 X |
| 3,796,402 | 3/1974 | Trotta | 248/101 X |

FOREIGN PATENT DOCUMENTS

| | | | |
|---|---|---|---|
| 158325 | 1/1904 | Fed. Rep. of Germany | 248/97 |

*Primary Examiner*—William H. Schultz

*Attorney, Agent, or Firm*—Diller, Ramik & Wight

[57] ABSTRACT

A collapsible, free standing bag holder for sustaining a bag in generally upright, open mouthed position comprising a collapsible frame of latticed struts surrounding the bag and to which the bag is attached in such a manner as to prohibit the frame from collapsing.

7 Claims, 10 Drawing Figures

COLLAPSIBLE BIN STRUCTURE

BACKGROUND OF THE INVENTION

The situations are innumerable in which there is a need to have a bag in an upright, open mouthed position ready for use. This invention provides a convenient arrangement for holding a bag in such a position to serve as a receptacle for trash, laundry, storage, etc.

The frame comprises a number of rigid struts pivotally connected to form a latticed structure that has a vertical, central passage to accommodate a bag. This central passage expands radially as the frame is collapsed vertically and therefore by setting the frame at an intermediate vertical height, the central passage will be of such dimensions as to accommodate a bag in an upright open mouthed position. The mouth of the bag is attached to the frame around the upper opening of the passage with the rest of the bag distending down into the passage as defined by the frame. The attachment of the bag to the frame also limits the radial expansion of the passage to maintain the frame at a free standing intermediate vertical height that will support the bag in an upright position.

By extending the frame to its full vertical height and consequently constricting the central passage, the frame becomes a relatively small package that is easily portable and conveniently stored.

The preceding features will be elaborated and other features brought to light in the following description.

BRIEF DESCRIPTION OF THE DRAWING FIGURES

DETAILED DESCRIPTION OF THE INVENTION

Figure 1:
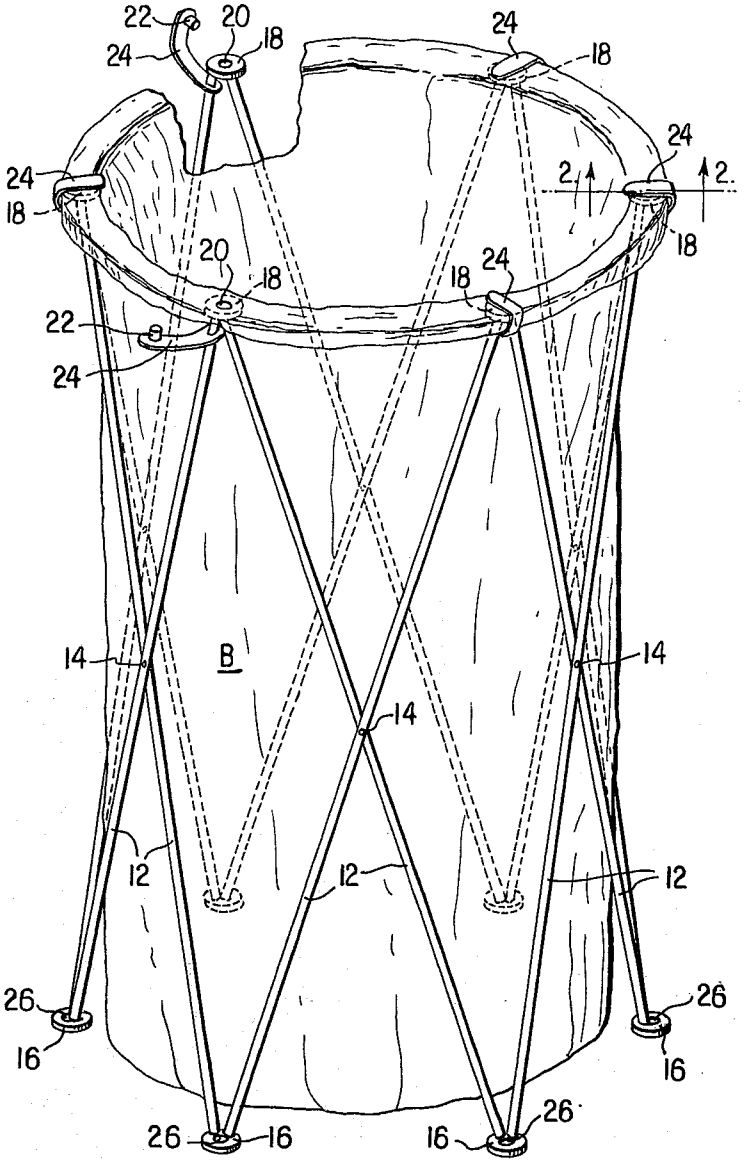
FIG. 1 illustrates the frame, the bag and the attachment fasteners in operative relation.
Figure 7:
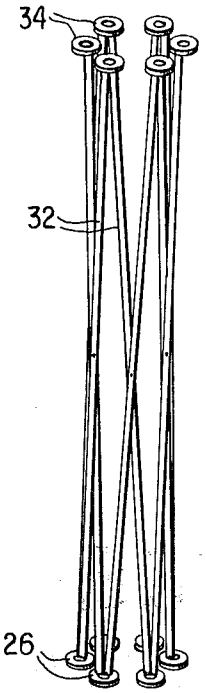
FIG. 7 shows the frame in a vertically extended radially constricted position.

Referring now to FIG. 1, the bag holder is shown in operative arrangement with the latticed rigid struts 12 which form the frame surrounding the bag B. The rigid struts 12 have pivotal connections 14 at their points of intersection and are pivotally joined at their ends through the hubs 18, 16 giving the frame the capability to be folded into a configuration as shown in FIG. 7 thus allowing it to collapse vertically moving the upper hubs 18 downward towards the lower hubs 16. When the frame is collapsed vertically, the central passage, occupied by the upright bag B, is expanded radially.

Figure 2:
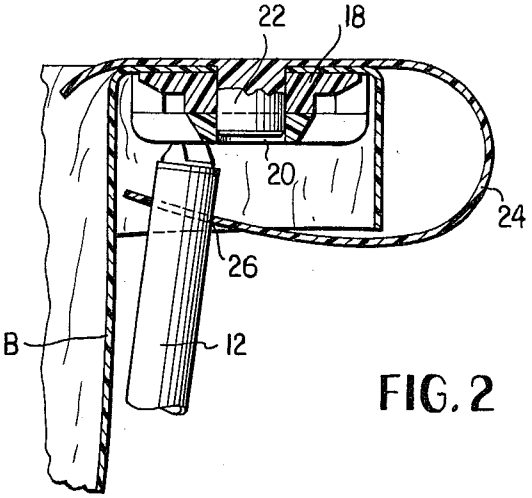
FIG. 2 is a cross section taken through plane 2 in FIG. 1 showing the bag attached to the upper frame portion with the fastener.
Figure 8:
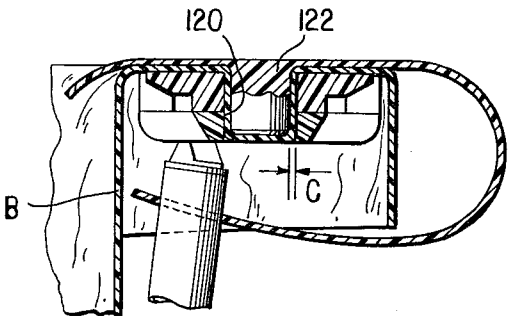
FIG. 8 is a cross section showing an alternate form of attaching the bag to the frame.

The upper hubs 18 have apertures 20 into which the protuberances 22 of the fasteners 24 are easily pushed by hand. The mouth of the bag B is folded outwardly over the upper hubs 18 and as shown in FIG. 2, the protuberance 22 is pressed through the bag B and into the aperture 20 clamping the bag between the flat surface of the hub 18 around the aperture and the flat surface of fastener 24 around the protuberance thereby attaching the bag to the frame. The fastener 24 has a hole 26 at its end opposite the protuberance 22, through which a strut 12 passes so as to permanently secure the fastener to the frame. An alternate means for attaching the bag to the frame (as shown in FIG. 8) involves a protuberance 122 smaller than the aperture 120 that establishes a clearance C therebetween that allows the bag to be pushed down into the aperture 120 by the protuberance 122 and fill the clearance C so as to form a snug fit that clamps the bag in place. Both of these arrangements for attaching the bag to the frame provide easy removal and replacement of the bag when required.

The bag 10 is attached to the frame with the fasteners 24 at each of the upper hubs 18 whereby the radial expansion of the central passage is limited to the extent to which the bag allows and further vertical collapse of the frame is prohibited. Thus the bag maintains the frame in operative position and the frame in turn supports the bag in an upright open mouthed position.

Figure 3:
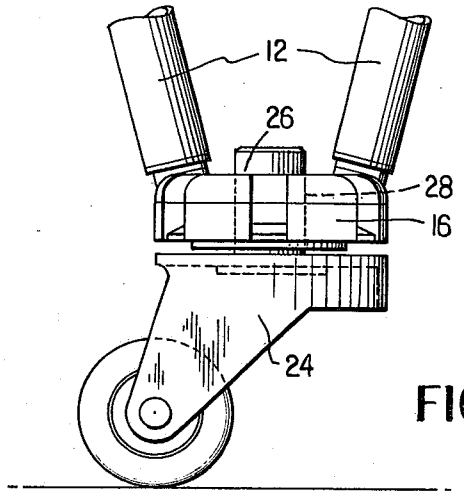
FIG. 3 is a side elevation of the lower frame fitted with a caster.

The lower hubs 16 are identical to the upper hubs 18 and they serve as the base or feet of the frame. In FIG. 3 an optional caster assembly 24 is shown having a protuberance 26 which is press fit into the aperture 28 of the hub 16.

Figure 4:
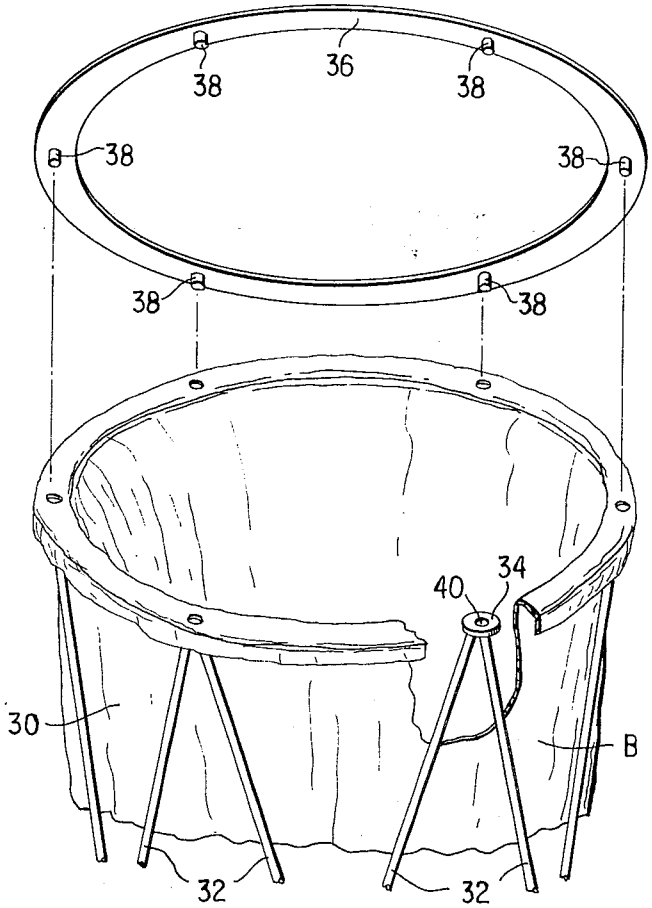
FIG. 4 illustrates an alternative fastener for attaching the bag to the upper frame portion.

FIG. 4 shows another manner in which the bag 30 is attached to the frame. The frame of rigid struts 32, the upper hubs 34 and bag's relationship to these are identical to that depicted in FIG. 1. The fastener 36 is a ring-like member that has a number of protuberances 38 which are pressed by hand into the apertures 40 of the upper hubs 34 to clamp the bag B in the same fashion as shown in FIG. 2 or FIG. 8. When the ring-like fastener 36 is used to attach the bag to the frame, the diameter of the fastener 36 determines the extent to which the frame will expand radially and thus set the vertical height of the frame.

Figure 5:
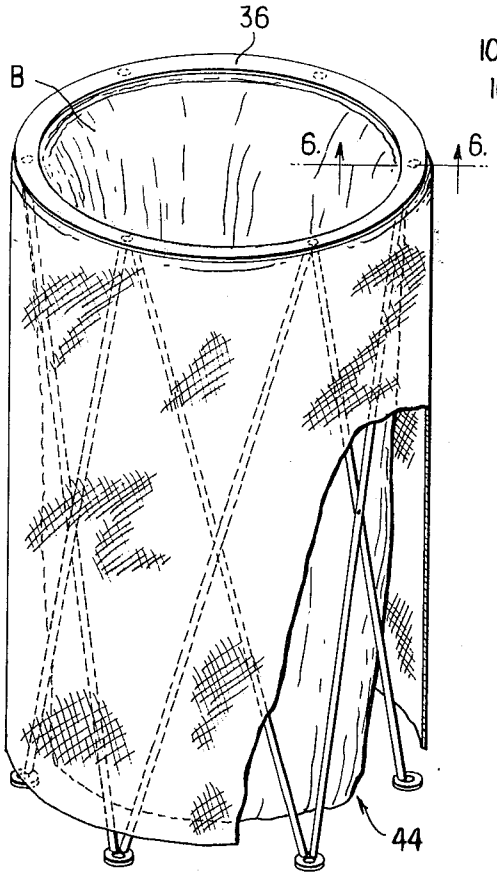
FIG. 5 illustrates an exterior covering for the frame.

FIG. 5 shows an exterior cover 42 which may be used for decorative purposes and hides the bag and frame assembly 44 from view.

Figure 6:
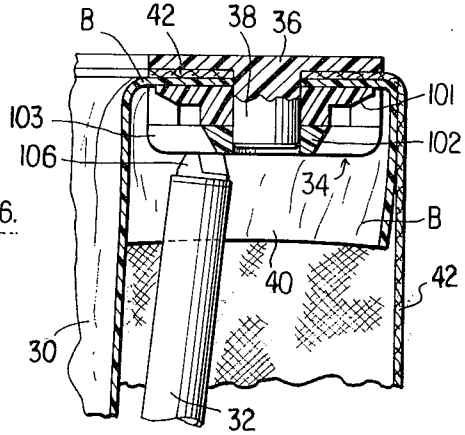
FIG. 6 is a cross section taken through plane 6 in FIG. 5 showing the exterior cover and the bag attached to the upper frame with the alternative fastener.

The cover 42 is attached to the frame by the same fastener 36 that attaches the bag B to the frame as shown in FIG. 6 in cross section taken from plane 6 in FIG. 6. The upper portion of the cover 42 is clamped over the bag B by a fastener 34 as protuberance 38 passes through both the cover and the bag into aperture 40 and the rest of the cover hangs down outside the struts 32 to substantially cover the exterior of the frame.

Figure 10:
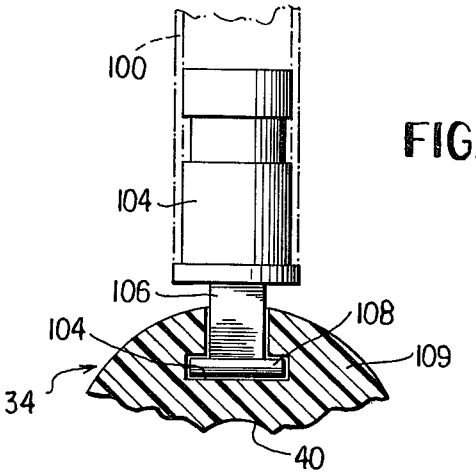
FIG. 10 is a cross sectioned fragment of a hub showing the pivotal connection of a strut to the hub.
Figure 9:
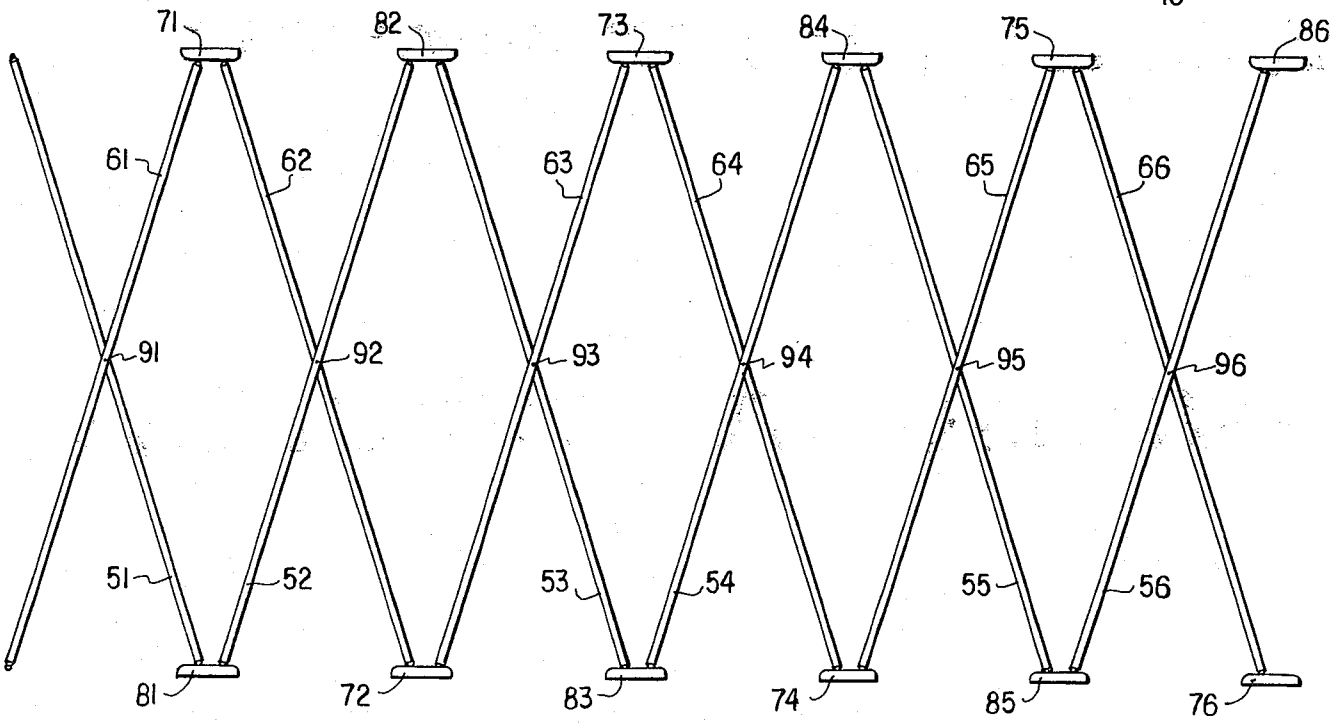
FIG. 9 illustrates the configuration of the struts with a flattened view.

FIG. 9 shows a frame disconnected and flattened to give a clear view of the configuration of the struts. A first set of struts 51–56 are connected end-to-end with hubs 81–86 to which each strut is independently pivotally attached as shown in FIG. 10. A second set of struts 61–66 are similarly connected with the hubs 71–76.

The two sets of struts are interwoven in a criss cross manner such that the adjacent struts of one set are alternatively positioned above and below the adjacent struts of the other set at their points of intersection 91–96 where they are pivotally attached and the adjacent hubs of the sets alternately form the upper and lower hubs. The upper hubs 71, 82, 73, 84, 75, 86, the point of intersection 91, 92, 93, 94, 95, 96 and the lower hubs 81, 72, 83, 74, 85, 76 each define three horizontal rows that are parallel.

To bring the configuration of struts as shown in FIG. 9 into the operative frame form as shown in FIG. 1 the free lower end of the first strut 61 of the second set of struts is pivotally attached to the last lower hub 76 of the second set of struts and the free upper end of the first strut 51 of the first set of struts is pivotally attached to the last upper hub 86 of the first set of struts. The upper and lower hubs are thus formed into two vertically displaced, axially aligned, parallel circular patterns with each upper hub directly above a lower hub and the criss crossed struts traversing the vertical displacement as shown in FIG. 1. The flat surfaces of the upper hubs are flush with a single horizontal plane that is parallel with the plane defined by the flat surfaces of the lower hubs.

FIG. 10 shows the independent pivotal attachment of a strut 100 to a hub such as the hub 34 of FIG. 6. The strut 100 has inserted into and secured to its end a plug 104 having an extension 106 beyond the strut 100 that terminates in a cross pivot pin 108. One portion 101 of the hub has a recess 110 extending radially away from the hub's central aperture 40, and accepts the extension 106 and the pivot pin 108 of the plug 104. The ends of the pivot pin 108 are captured by the other portion 102 of the hub such that the pin 108 cannot be withdrawn from, but is rotatable within the recess 110, thus pivotally attaching the strut 100 to the hub 34. Each hub is provided with at least two recess as described in order to accommodate the two struts which it connects. It will also be appreciated that each portion 102 is simply bonded adhesively to the portion 101 during final assembly and, as is clear from FIG. 6, the portion 102 is provided with radial slots 103 to clear the extensions 106, as shown. The hubs may be provided with six recesses as is the case in FIG. 6, but only two are required, spaced approximately 120° apart circumferentially of the hub.

The hub and strut connections thereto may take any convenient form as, for example, is shown in FIGS. 13–16 of U.S. Pat. No. 4,026,313, incorporated herein by reference, but unlike the hubs shown in the patent, the struts of this invention are circumferentially spaced by 120° as stated above.

What is claimed is:

1. A collapsible, free standing bag holder for sustaining a bag in generally upright, open mouthed position comprising;

a surrounding frame of latticed rigid struts pivotally joined at each intersection and having a vertical central passage whereby said passage expands radially as said frame collapses vertically;

a bag positioned within said frame having its mouth generally aligned with the upper opening of said passage such that its body is distensible down into said passage;

means for attaching said bag to said frame at points about said upper opening to maintain the mouth of said bag open and prohibiting the radial expansion of said opening so as to maintain a vertical height of said frame that will substantially accommodate the distended body of the bag, said frame comprising a first set of rigid struts joined end-to-end by hubs to which each strut is independently pivotally attached to form a closed loop, a second set of an equal number of struts that are joined end-to-end in the same manner as the first set of struts and with each strut intersecting one strut of the first set where they are pivotally attached such that the adjacent hubs of the first and second sets are alternately disposed in two horizontally superposed circular patterns in parallel upper and lower horizontal planes.

2. A bag holder as defined in claim 1 wherein each of said hubs disposed in said upper horizontal plane is provided with a central aperture, the means for attaching comprises separate fasteners each having a protuberance removably insertable into a corresponding one of said central apertures and the portion of said bag between the points of attachment prohibits the radial expansion of the central passage.

3. A bag holder as defined in claim 1 wherein each of said hubs disposed in said upper horizontal plane is provided with a central aperture, the means for attaching comprises a ring-like member having protuberences projecting therefrom each removably insertable into a corresponding central aperture and positioned on said member whereby the radius of said member determines the extent to which the central passage is expanded.

4. A bag holder as defined in claim 3 wherein a gradually cylindrical covering is also attached to said frame by said member at the same points at which said bag is attached so as to cover the exterior of said frame.

5. A collapsible, free standing bag holder for sustaining a bag in generally upright, open mouthed position comprising;

a surrounding frame of latticed rigid struts pivotally joined at each intersection and having a vertical central passage whereby said passage expands radially as said frame collapses vertically;

a bag positioned within said frame having its mouth generally aligned with the upper opening of said passage such that its body is distensible down into said passage;

means for attaching said bag to said frame at points about said upper opening to maintain the mouth of said bag open and prohibiting the radial expansion of said opening so as to maintain a vertical height of said frame that will substantially accommodate the distended body of the bag, said frame including a plurality of hubs, each pivotally connecting a different pair of struts in end-to-end relation.

6. A bag holder as defined in claim 5 wherein said struts are arranged in two sets thereof, each set comprising a number of struts connected in end-to-end relation by corresponding hubs, and corresponding struts of the two sets being criss-crossed and pivotally joined at their intersections.

7. A bag holder as defined in claim 6 wherein each hub comprises mating portions defining recesses pivotally capturing the ends of the struts associated therewith.

* * * * *